US008957823B2

(12) United States Patent
Lee et al.

(10) Patent No.: US 8,957,823 B2
(45) Date of Patent: Feb. 17, 2015

(54) RADIATOR USING A DIELECTRIC MEMBER AND ANTENNA INCLUDING THE SAME

(75) Inventors: Ju-Hyun Lee, Gyeonggi-Do (KR); Jin-Woo Kim, Busan (KR); Mi-Hee Hwang, Incheon (KR)

(73) Assignee: Ace Technologies Corporation, Incheon (KR)

( * ) Notice: Subject to any disclaimer, the term of this patent is extended or adjusted under 35 U.S.C. 154(b) by 355 days.

(21) Appl. No.: 13/214,752

(22) Filed: Aug. 22, 2011

(65) Prior Publication Data

US 2012/0044118 A1 Feb. 23, 2012

Related U.S. Application Data

(63) Continuation of application No. PCT/KR2010/001043, filed on Feb. 19, 2010.

(30) Foreign Application Priority Data

Feb. 23, 2009 (KR) ..... 10-2009-0014822

(51) Int. Cl.

| | |
|---|---|
| ***H01Q 9/28*** | (2006.01) |
| ***H01Q 21/00*** | (2006.01) |
| ***H01Q 21/26*** | (2006.01) |
| ***H01Q 1/24*** | (2006.01) |
| ***H01Q 21/08*** | (2006.01) |
| ***H01Q 25/00*** | (2006.01) |
| ***H01Q 19/10*** | (2006.01) |

(52) U.S. Cl.

CPC ..... *H01Q 21/26* (2013.01); *H01Q 1/246* (2013.01); *H01Q 21/08* (2013.01); *H01Q 25/001* (2013.01); *H01Q 19/106* (2013.01)

USPC ..... 343/795; 343/810

(58) Field of Classification Search

CPC ..... H01Q 1/22; H01Q 1/246; H01Q 21/24; H01Q 21/08; H01Q 21/26; H01Q 21/062; H01Q 21/28

USPC ..... 343/795, 797, 793, 725, 810, 817, 820, 343/744

See application file for complete search history.

(56) References Cited

U.S. PATENT DOCUMENTS

| | | | | |
|---|---|---|---|---|
| 6,208,308 | B1 * | 3/2001 | Lemons | 343/785 |
| 6,597,324 | B2 * | 7/2003 | Eriksson | 343/795 |
| 7,629,939 | B2 * | 12/2009 | Deng et al. | 343/821 |

* cited by examiner

*Primary Examiner* — Hoang V Nguyen
*Assistant Examiner* — Patrick Holecek
(74) *Attorney, Agent, or Firm* — Mintz Levin Cohn Ferris Glovsky and Popeo, P.C.; Kongsik Kim

(57) ABSTRACT

A radiator for improving beam pointing error and beam tracking error using a dielectric member and an antenna including the same are disclosed. The radiator includes a first dipole member, a second dipole member adjacent to the first dipole member, a third dipole member facing to the first dipole member, and a fourth dipole member facing to the second dipole member. Here, the first to fourth dipole members have square shape, and a dielectric member is connected to at least one of the first to fourth dipole members.

8 Claims, 9 Drawing Sheets

(A)

(B)

(A)

(B)

(A) (B)

(A)

(B)

RADIATOR USING A DIELECTRIC MEMBER AND ANTENNA INCLUDING THE SAME

CROSS-REFERENCE TO RELATED APPLICATION

This is a continuation application of PCT/KR2010/001043 filed on Feb. 19, 2010, which claims the benefit of Korean Application No. 10-2009-014822 filed Feb. 23, 2009, the entire contents of which applications are incorporated herein by reference.

TECHNICAL FIELD

Example embodiment of the present invention relates to a radiator and an antenna including the same, more particularly relates to a radiator for improving beam pointing error and beam tracking error using a dielectric member and an antenna including the same.

BACKGROUND ART

An antenna transmits/receives electromagnetic wave by outputting certain radiation pattern, and realizes generally only one frequency band. However, it has been required to realize a plurality of frequency bands in recent, and so multi band dual polarization antenna shown in following FIG. 1 has been developed.

FIG. 1 is a perspective view illustrating schematically common multi band dual polarization antenna, and FIG. 2 is a view illustrating beam pointing error of the antenna in FIG. 1.

In FIG. 1, a multi band dual polarization antenna includes a reflection plate 100, first radiators 102 and second radiators 104.

The first radiators 102 are formed on the reflection plate 100, are used for low frequency band, and generate dual polarized wave (±45° polarized waves).

The second radiator 104 locates inside the first radiator 102, is used for high frequency band, and generates dual polarized wave (±45° polarized waves).

Center of a main beam of a radiation pattern in the antenna shifts along θ axis in accordance with change of tilting angle of the antenna as shown in FIG. 2(A) in case that the main beam is normally outputted. However, the center of the main beam shifts really along a beam pointing line 200 as shown in FIG. 2(B). As a result, beam pointing error occurs by an angle 202.

Beam tracking error means difference of horizontal gain of ±45° polarized waves. The beam tracking error increases also according as the tilting angle of the antenna is changed.

That is, the antenna may not output the radiation pattern in the desired direction due to the beam pointing error and the beam tracking error.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

An example embodiment of the present invention provides a radiator for reducing beam pointing error and beam tracking error and an antenna including the same.

In one aspect, the present invention provides a radiator used in an antenna comprising: a first dipole member; a second dipole member adjacent to the first dipole member; a third dipole member facing to the first dipole member; and a fourth dipole member facing to the second dipole member. Here, the first to fourth dipole members have square shape, and a dielectric member is connected to at least one of the first to fourth dipole members.

The first dipole member includes a 1-1 sub-dipole member for (+) current and a 1-2 sub-dipole member for (−) current, and the third dipole member has a 3-1 sub-dipole member for (+) current and a 3-2 sub-dipole member for (−) current. Here, a first dielectric member is combined with end part of the 1-1 sub-dipole member, and a second dielectric member is combined with end part of the 3-2 sub-dipole member.

The second dipole member includes a 2-1 sub-dipole member for (+) current and a 2-2 sub-dipole member for (−) current, and the fourth dipole member has a 4-1 sub-dipole member for (+) current and a 4-2 sub-dipole member for (−) current. Here, a third dielectric member is combined with end part of the 2-1 sub-dipole member, and a fourth dielectric member is combined with end part of the 4-2 sub-dipole member.

The first dielectric member and the fourth dielectric member are formed in one body, and the second dielectric member and the third dielectric member are formed in one body.

The antenna is a multi-band dual polarization antenna, the radiator is used for low frequency band, and the dipole members generate ±45° polarized waves through a combination method.

A slit is formed to at least one of the first dipole member to the fourth dipole member.

In another aspect, the present invention provides a radiator employed in an antenna comprising: a first dipole member configured to have a 1-1 sub-dipole member for (+) current and a 1-2 sub-dipole member for (−) current; and a second dipole member configured to face to the first dipole member, and have a 2-1 sub-dipole member for (+) current and a 2-2 dipole member for (−) current. Here, electrical length of the 1-1 sub-dipole member or the 2-1 sub-dipole member is longer than physical length of the 1-1 sub-dipole member or the 2-1 sub-dipole member.

Electrical length of the 2-2 sub-dipole member is longer than physical length of the 2-2 sub-dipole member in case that the electrical length of the 1-1 sub-dipole member increases, and electrical length of the 1-2 sub-dipole member is longer than physical length of the 1-2 sub-dipole member in case that the electrical length of the 2-1 sub-dipole member increases The electrical length increases through connecting a dielectric member to end part of corresponding sub-dipole member.

The antenna is a multi-band dual polarization antenna, the radiator is used for low frequency band, and the dipole members generate +45° polarized wave or −45° polarized wave through a combination method.

A radiator of the present embodiment increases electrical length of corresponding dipole members using dielectric members, and thus beam pointing error and beam tracking error of an antenna employing the radiator may reduce. Here, the dielectric members are connected to a sub-dipole member for (+) current and a sub-dipole member for (−) current of dipole members in the radiator, respectively.

BRIEF DESCRIPTION OF DRAWINGS

Example embodiments of the present invention will become more apparent by describing in detail example embodiments of the present invention with reference to the accompanying drawings, in which.

DETAILED DESCRIPTION OF THE DISCLOSURE

Hereinafter, embodiments of the present invention will be described in detail with reference to accompanying drawings.

Figure 1:
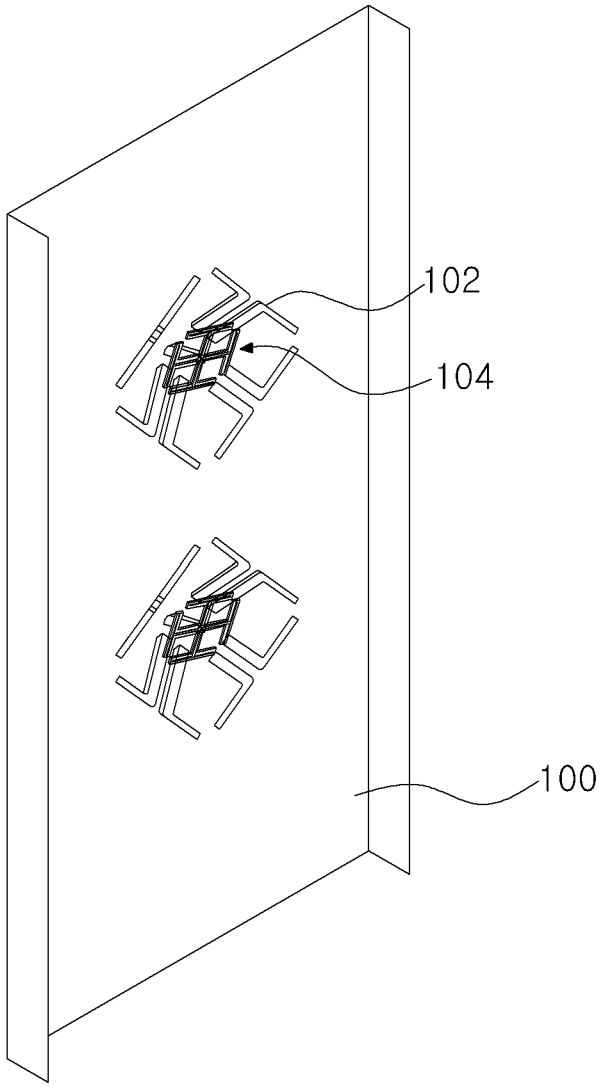
FIG. 1 RELATED ART
FIG. 1 is a perspective view illustrating schematically common multi band dual polarization antenna.
Figure 2:
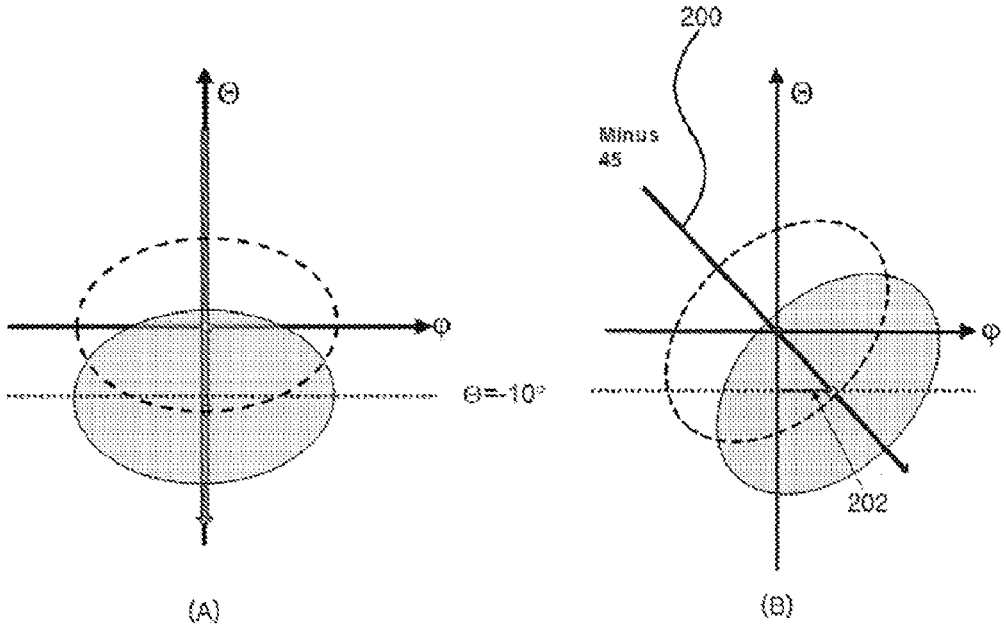
FIG. 2 RELATED ART
FIG. 2 is a view illustrating beam pointing error of the antenna in FIG. 1.
Figure 3:
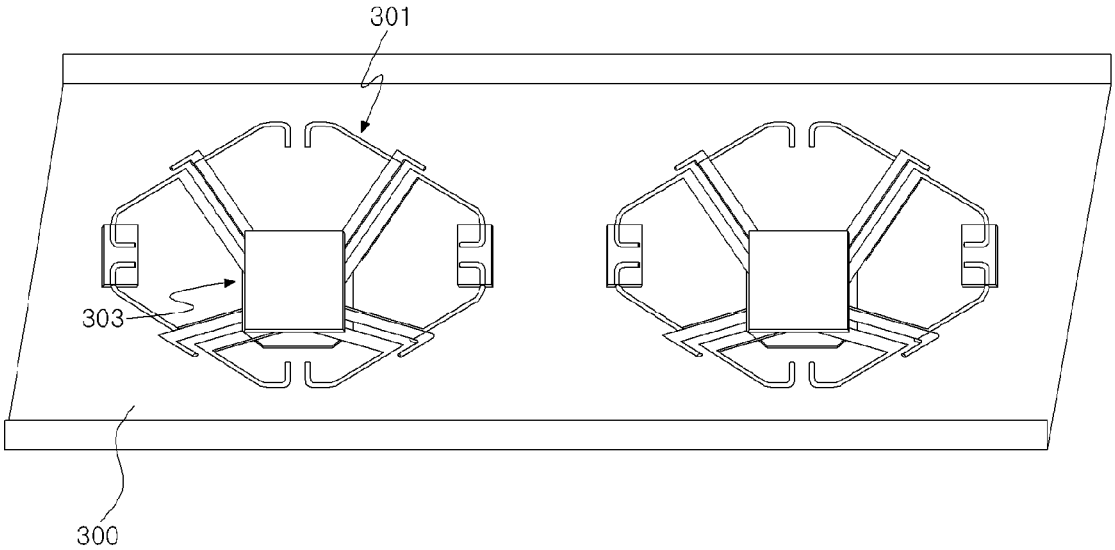
FIG. 3 is a perspective view illustrating an antenna according to one example embodiment of the present invention.
Figure 3:
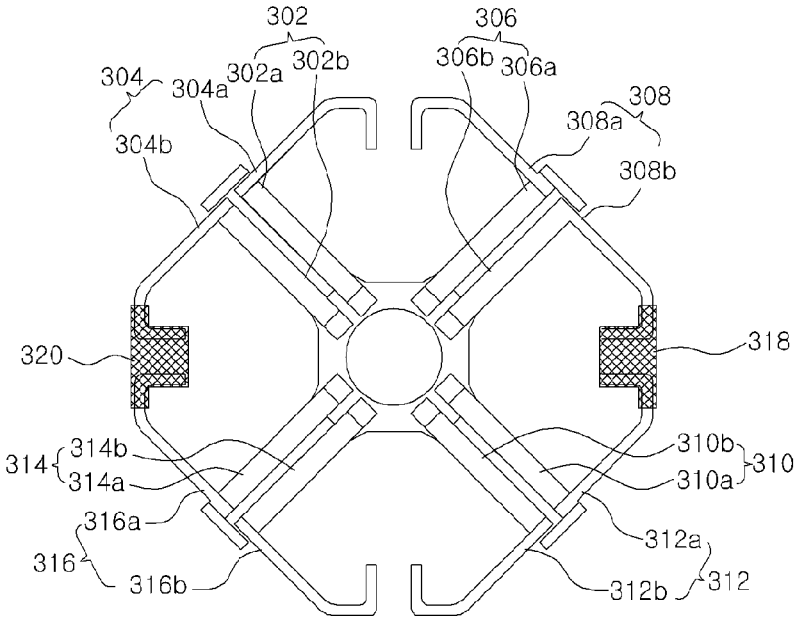
Figure 4:
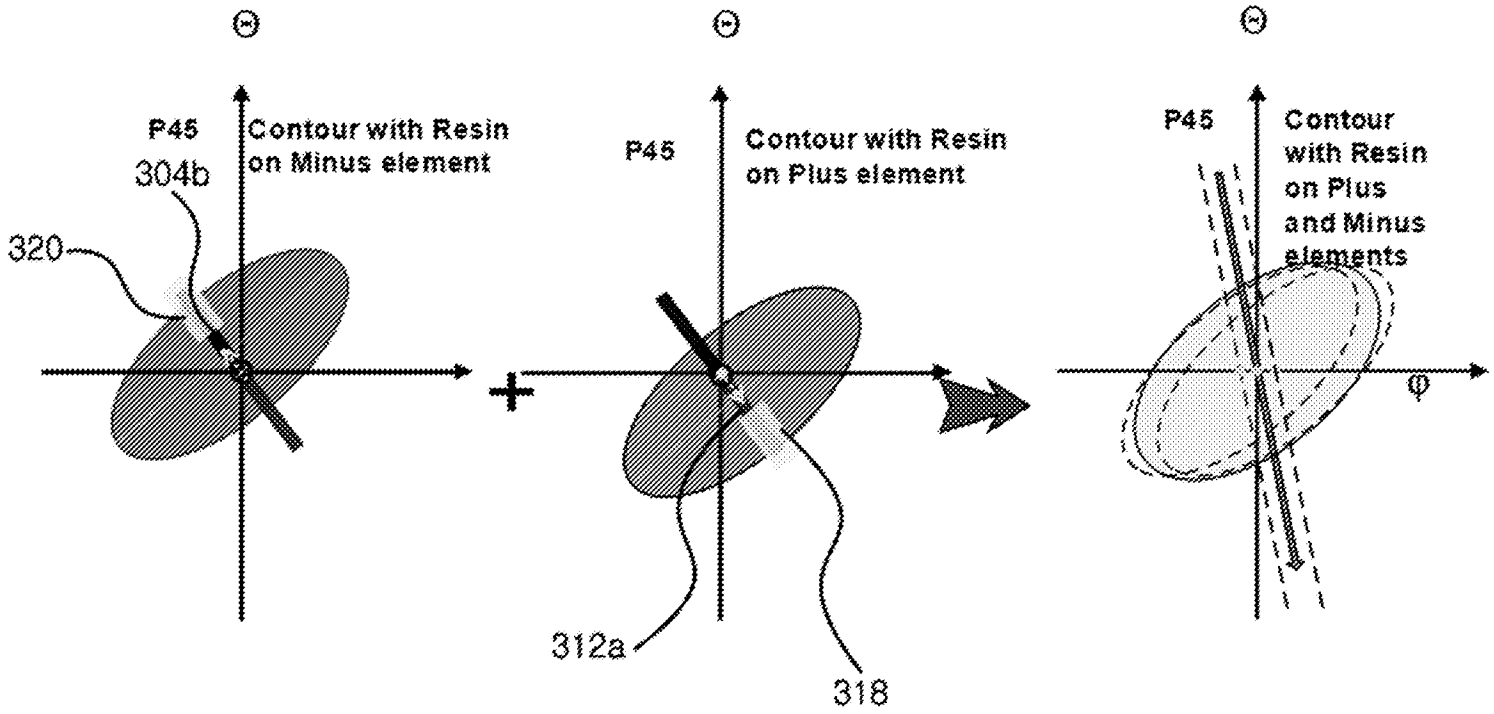
FIG. 4 is a view illustrating a process of improving beam pointing error of a radiator according to one example embodiment of the present invention.

FIG. 3 is a perspective view illustrating an antenna according to one example embodiment of the present invention, and FIG. 4 is a view illustrating a process of improving beam pointing error of a radiator according to one example embodiment of the present invention.

Various kinds of antennas may be used as an antenna of the present invention. Hereinafter, the antenna will be assumed as a dual band dual polarization antenna DBDP for convenience of description.

In FIG. 3(A), the antenna includes a reflection plate 300, a first radiator 301 and a second radiator 303.

The reflection plate 300 functions as a ground and a reflector, and is bent in specific direction as shown in FIG. 3(A) or has plane shape. Here, bending direction of the reflection plate 300 is not limited in the specific direction.

The first radiator 301 is used for low frequency band, is disposed on the reflection plate 300, and outputs radiation pattern through a combination method as described below.

The second radiator 303 is used for high frequency band, locates inside the first radiator 301, and outputs radiation pattern through various methods such as the combination method or a vector synthesizing method, etc.

Hereinafter, the first radiator 301 for generating ±45° polarized waves will be described in detail.

In FIG. 3(B), the first radiator 301 includes feeding lines 302, 306, 310 and 314, dipole members 304, 308, 312 and 316 and dielectric members 318 and 320.

The first dipole member 304 is electrically connected to the feeding lines 302*a* and 302*b*, and includes a 1-1 sub-dipole member 304*a* connected to the feeding line 302*a* and a 1-2 sub-dipole member 304*b* connected to the feeding line 302*b*. Here, (+) current is provided to the 1-1 sub-dipole member 304*a* through the feeding line 302*a*, and (−) current is provided to the 1-2 sub-dipole member 304*b* through the feeding line 302*b*. Current inputted from outside flows to the feeding line 302*b* through the feeding line 302*a*.

The second dipole member 308 is adjacent to the first dipole member 304, is electrically connected to the feeding lines 306*a* and 306*b*, and includes a 2-1 sub-dipole member 308*a* connected to the feeding line 306*a* and a 2-2 sub-dipole member 308*b* connected to the feeding line 306*b*. Here, (+) current is provided to the 2-1 sub-dipole member 308*a* through the feeding line 306*a*, and (−) current is provided to the 2-2 sub-dipole member 308*b* through the feeding line 306*b*.

The third dipole member 312 faces to the first dipole member 304, is electrically connected to the feeding lines 310*a* and 310*b*, and includes a 3-1 sub-dipole member 312*a* connected to the feeding line 310*a* and a 3-2 sub-dipole member 312*b* connected to the feeding line 310*b*. Here, (+) current is provided to the 3-1 sub-dipole member 312*a* through the feeding line 310*a*, and (−) current is provided to the 3-2 sub-dipole member 312*b* through the feeding line 310*b*.

The fourth dipole member 316 faces to the second dipole member 308, is electrically connected to the feeding lines 314*a* and 314*b*, and includes a 4-1 sub-dipole member 316*a* connected to the feeding line 314*a* and a 4-2 sub-dipole member 316*b* connected to the feeding line 314*b*. Here, (+) current is provided to the 4-1 sub-dipole member 316*a* through the feeding line 314*a*, and (−) current is provided to the 4-2 sub-dipole member 316*b* through the feeding line 314*b*.

That is, the dipole members 304, 308, 312 and 316 may have square shape, and include the sub-dipole members 304*a*, 304*b*, 308*a*, 308*b*, 312*a*, 312*b*, 316*a* and 316*b*, respectively.

In case that current is provided to the first dipole member 304 and the third dipole member 312 in the first radiator 301, electric fields generate by currents flowing through the dipole members 304 and 312, and +45° polarized wave is generated according as the electric fields are synthesized. In this case, the second dipole member 308 and the fourth dipole member 316 do not affect to generation of the +45° polarized wave. This method is referred to as the combination method.

In case that current is provided to the second dipole member 308 and the fourth dipole member 316, electric fields generate by currents flowing through the dipole members 308 and 316, and −45° polarized wave is generated according as the electric fields are synthesized. In this case, the first dipole member 304 and the third dipole member 312 do not affect to generation of the −45° polarized wave.

In other words, the first radiator 301 generates ±45° polarized waves through the combination method. In this case, beam pointing error might occur. Accordingly, the antenna of the present invention reduces the beam pointing error using the dielectric members 318 and 320.

Particularly, the first dielectric member 318 is connected to a part of the 2-2 sub-dipole member 308*b* for (−) current, e.g. end part and a part of the 3-1 sub-dipole member 312*a* for (+) current, e.g. end part. As a result, electrical length of each of the 2-2 sub-dipole member 308*b* and the 3-1 sub-dipole member 312*a* increase.

The second dielectric member 320 is connected to a part of the 4-1 sub-dipole member 316*a* for (+) current, e.g. end part and a part of the 1-2 sub-dipole member 304*b* for (−) current, e.g. end part. As a result, electrical length of each of the 4-1 sub-dipole member 316*a* and the 1-2 sub-dipole member 304*b* increase.

Hereinafter, beam pointing error when the dipole members 318 and 320 are combined with the dipole members 304, 308, 312 and 316 will be described in detail. The beam pointing error related to +45° polarized wave will be described as example of the beam pointing error for convenience of description.

As shown in FIG. 4, beam of the 1-2 sub-dipole member 304*b* for (−) current shifts in the left direction by connecting the second dielectric member 320 to the 1-2 sub-dipole member 304*b*, and beam of the 3-1 sub-dipole member 312*a* for (+) current shifts in the right direction by connecting the first dielectric member 318 to the 3-1 sub-dipole member 312*a*.

That is, center of the beam of specific dipole member shifts in the left or right direction by connecting corresponding dielectric member to the dipole member. Here, in case that the beams are synthesized, contour of a synthesized beam increases and beam pointing error of the antenna of the present invention is lower than that of conventional antenna. This will be described in detail with reference to accompanying experimental result.

In brief, the antenna of the present embodiment connects the dielectric member to the sub-dipole member for (−) current and the sub-dipole member for (+) current, thereby increasing electrical length of the sub-dipole members. As a result, the beam pointing error of the antenna may reduce. However, the present invention does not connect a dielectric member to only sub-dipole members for (+) current, and does not connect a dielectric member to only sub-dipole members for (−) current. This is because the beam pointing error may increase.

In FIG. 3, the dielectric member 318 or 320 is combined with adjoining two sub-dipole members 308*b* and 312*a*, 316*a* and 304*b*. However, four dielectric members may be combined with the sub-dipole members 308*b*, 312*a*, 316*a* and 304*b*, respectively.

In addition, the dielectric member is not limited as specific dielectric material as long as the dielectric member increases the electrical length of at least one of the sub-dipole members 308*b*, 312*a*, 316*a* and 304*b*.

Slit may be formed to at least one of the dipole members 304, 308, 312 and 316, which is not shown in FIG. 3. The dielectric member 318 or 320 may be combined with the dipole members 308*b*, 312*a*, 316*a* and 304*b* having the slit.

Figure 5:
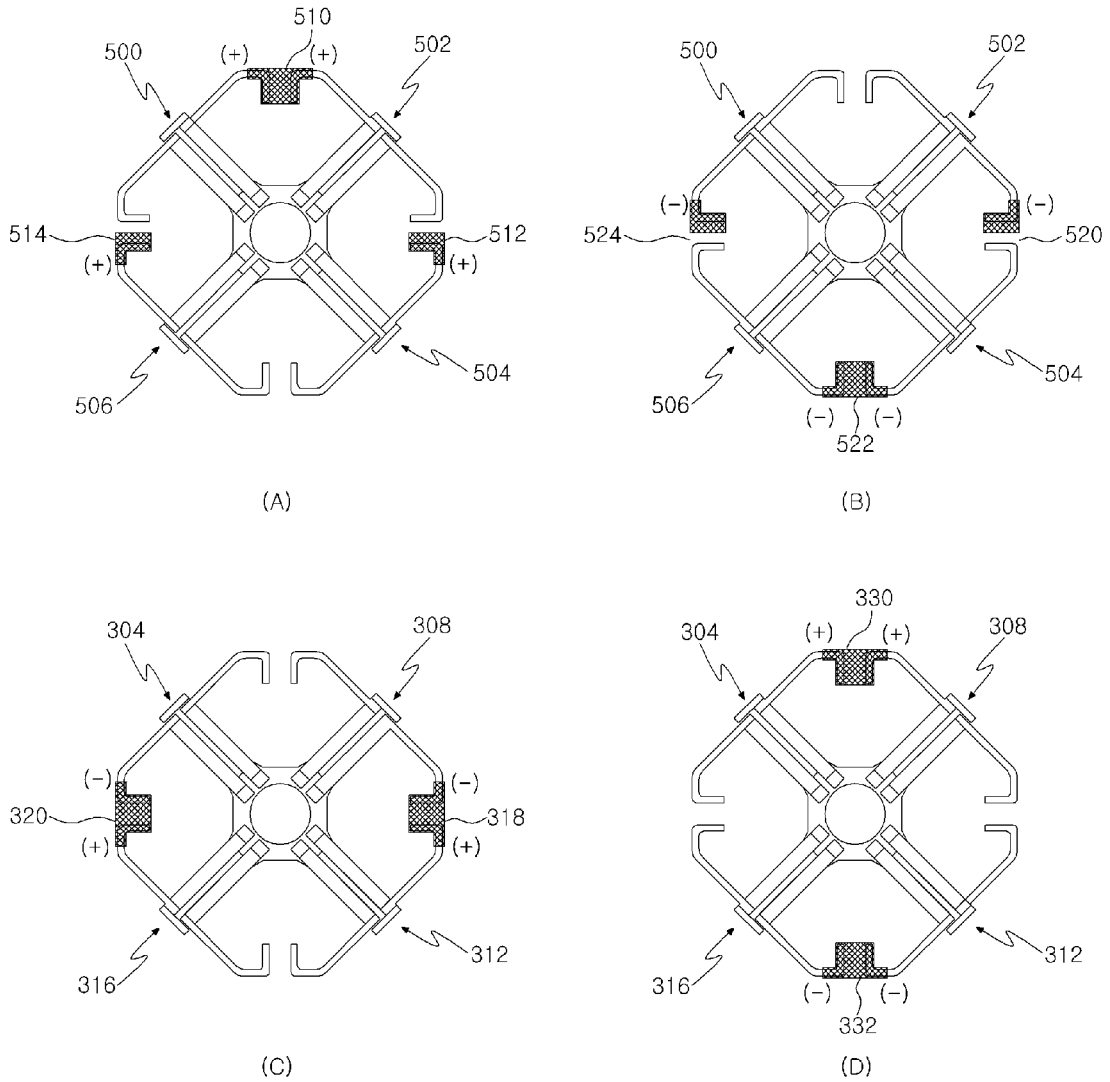
FIG. 5 is a view illustrating radiators using dielectric members.
Figure 6:
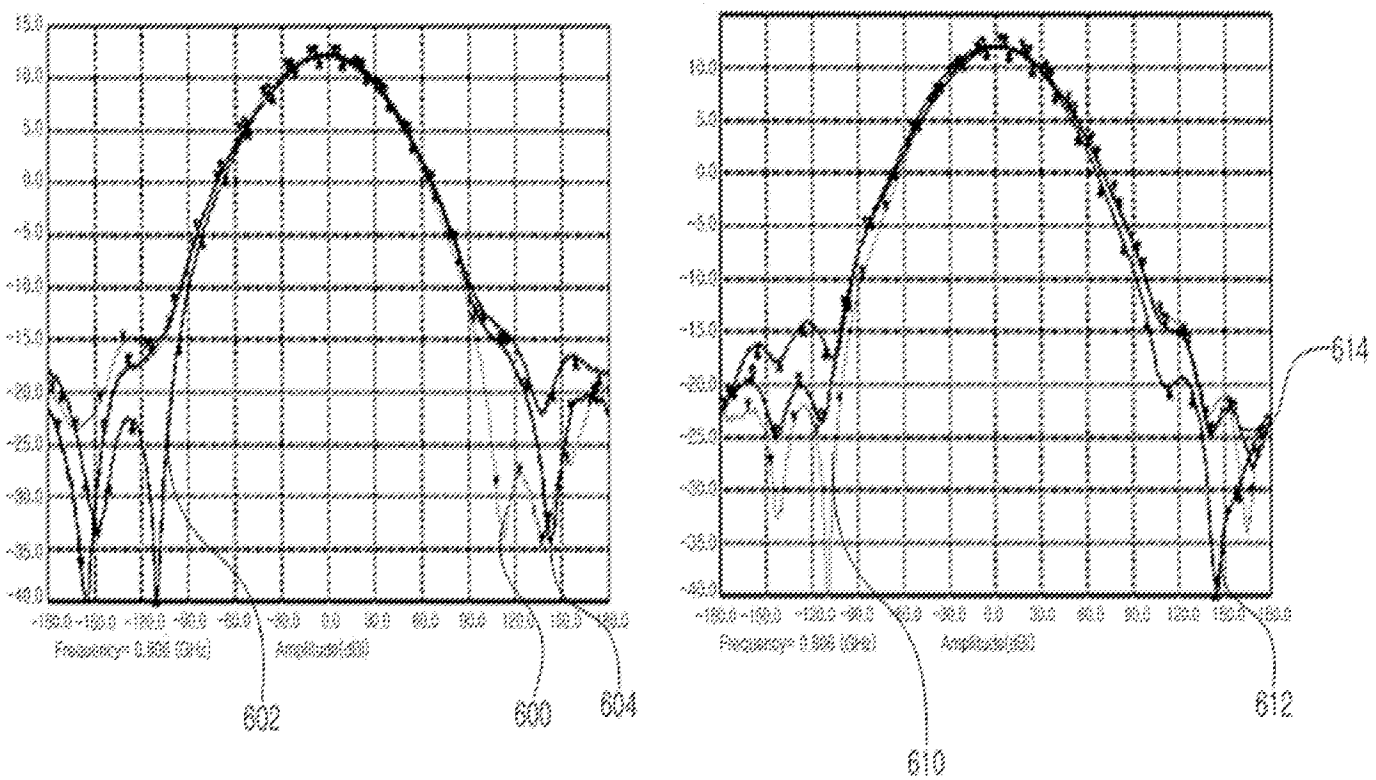
FIG. 6 is a view illustrating azimuth pattern of the radiators in FIG. 5.

FIG. 5 is a view illustrating radiators using dielectric members, and FIG. 6 is a view illustrating azimuth pattern of the radiators in FIG. 5.

In FIG. 5(A), in a 1-1 radiator, dielectric members 510, 512 and 514 are combined with only sub-dipole members for (+) current of dipole members 500, 502, 504 and 506 for generating ±45° polarized wave.

In FIG. 5(B), in a 1-2 radiator, dielectric members 520, 522 and 524 are combined with only sub-dipole members for (−) current of the dipole members 500, 502, 504 and 506 for generating ±45° polarized wave.

In FIG. 5(C) and FIG. 5(D), in the first radiator 301, the dielectric members 318, 320, 330 and 332 are combined with the sub-dipole member for (−) current and the sub-dipole member for (+) current of the dipole members 304, 308, 312 and 316.

In FIG. 6, it is verified that azimuth pattern 600 and 610 of the 1-1 radiator is inclined in (+) direction, and azimuth pattern 602 and 612 of the 1-2 radiator is inclined in (−) direction. Whereas, it is verified that azimuth pattern 604 and 614 of the first radiator 301 of the present embodiment is not inclined in specific direction compared with the patterns 600 and 602 of the 1-1 radiator and the 1-2 radiator.

That is, the antenna may realize excellent radiation characteristics only in case that the dielectric members are combined with the sub-dipole member for (+) current and the sub-dipole member for (−) current, respectively.

Figure 7:
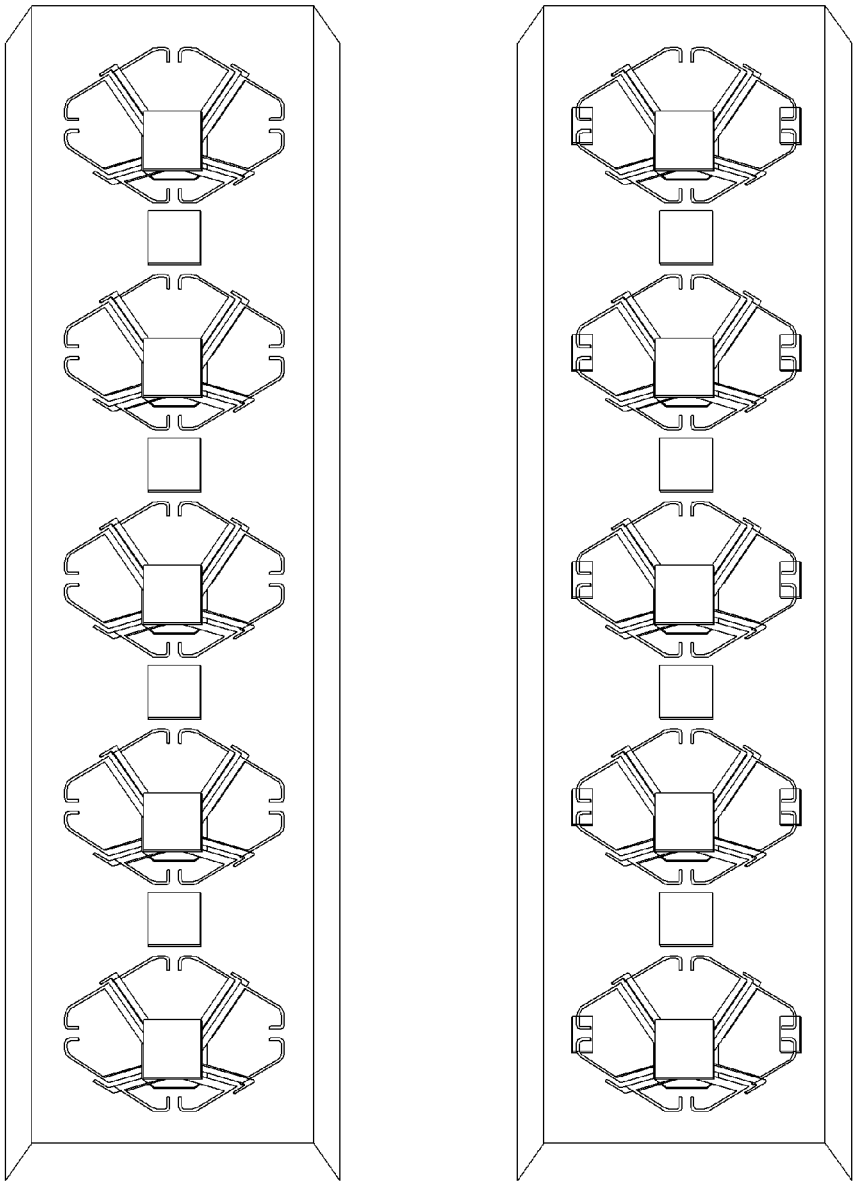
FIG. 7 is a view illustrating an array antenna having radiators for test of the beam pointing error.
Figure 8:
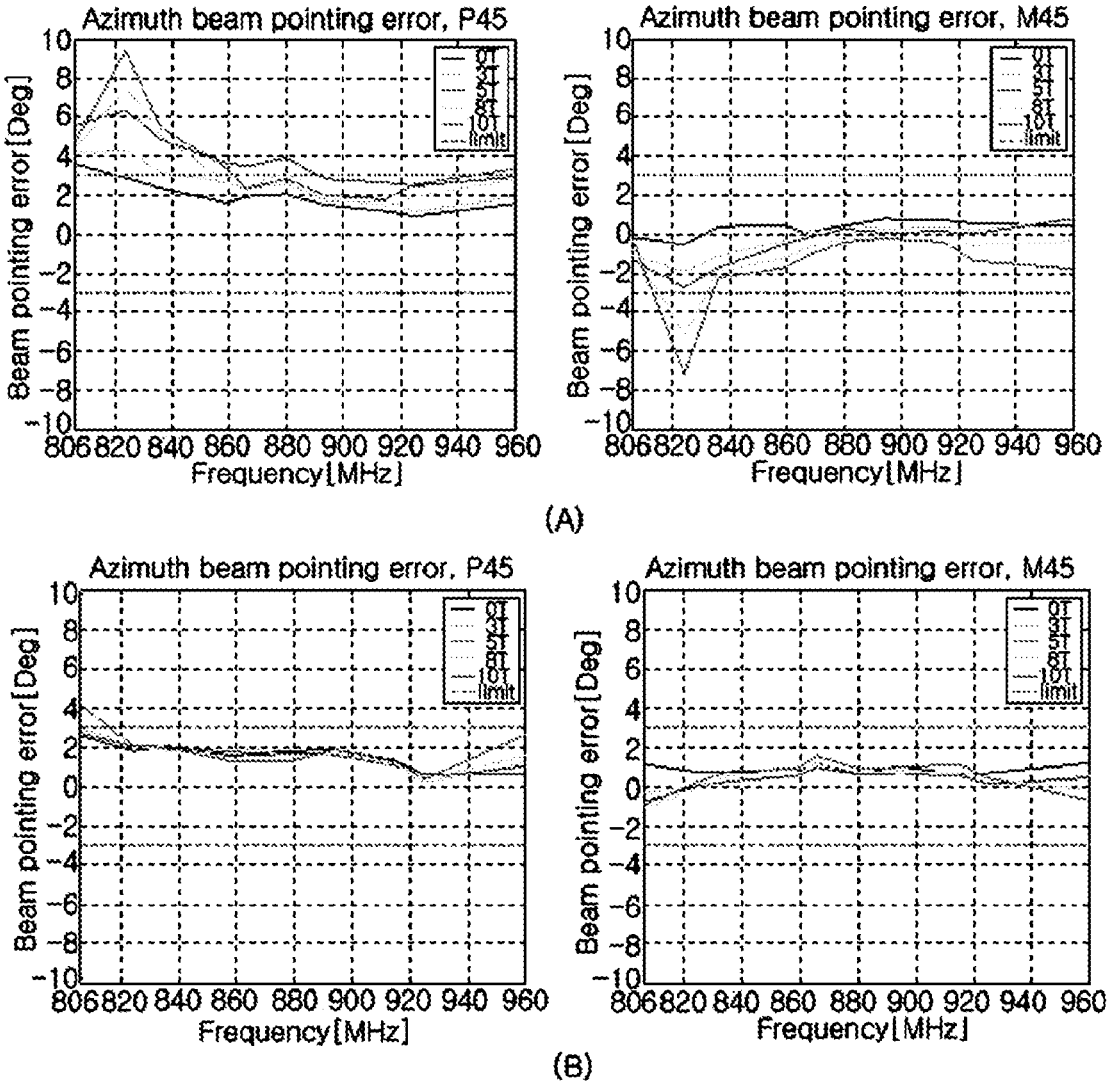
FIG. 8 is a view illustrating the beam pointing error of the array antenna in FIG. 7.
Figure 9:
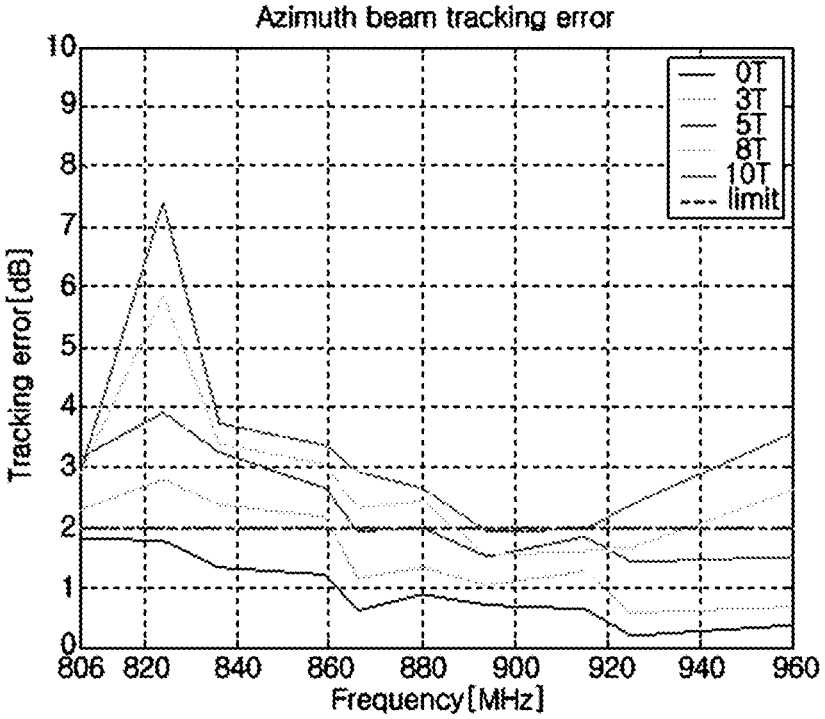
FIG. 9 is a view illustrating beam tracking error of the array antenna in FIG. 7.
Figure 9:
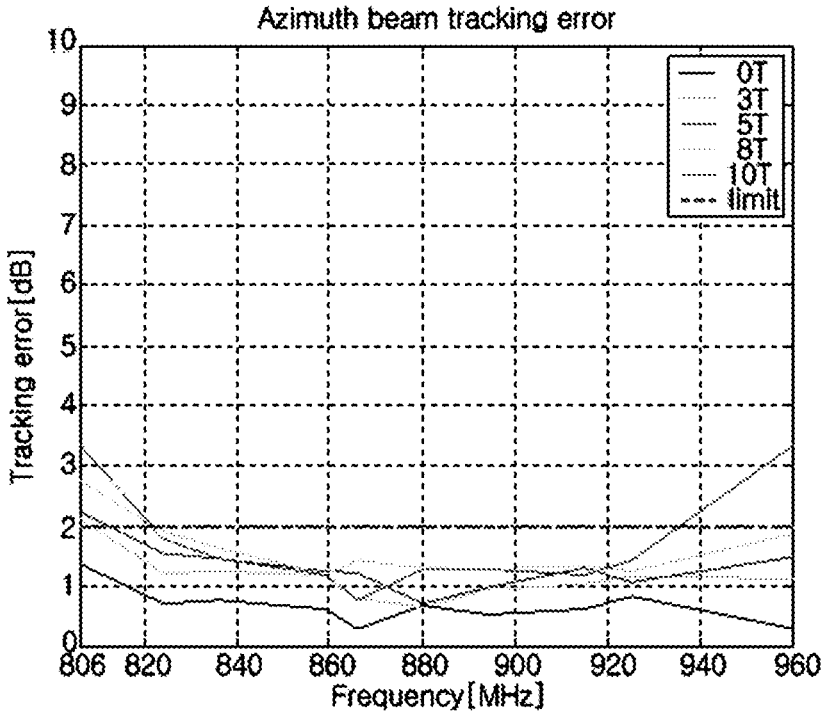

FIG. 7 is a view illustrating an array antenna having radiators for test of the beam pointing error, and FIG. 8 is a view illustrating the beam pointing error of the array antenna in FIG. 7. FIG. 9 is a view illustrating beam tracking error of the array antenna in FIG. 7.

FIG. 7(A) shows conventional array antenna (multi-band dual polarization antenna) including radiators where a dielectric member is not combined with dipole members, and FIG. 7(B) illustrates an array antenna (multi-band dual polarization antenna) including radiators where the dielectric member is combined with the dipole members.

As shown in FIG. 8(A), beam pointing error of radiation pattern (±45° polarized wave) of conventional antenna increases according as tilt (tilting angle) of the antenna augments. Especially, severe beam pointing error occurs at approximately 820 MHz.

However, beam pointing error of radiation pattern (±45° polarized wave) of antenna of the present embodiment does not increase nearly though tilt (tilting angle) of the antenna augments as shown in FIG. 8(B).

In other words, the beam pointing error of the antenna of the present embodiment may be improved compared to that of the conventional antenna not using the dielectric member.

As shown in FIG. 9(A), beam tracking error of radiation pattern (±45° polarized wave) of the conventional antenna increases according as tilt (tilting angle) of the antenna augments. Especially, severe beam tracking error occurs at approximately 820 MHz.

However, beam tracking error of radiation pattern (±45° polarized wave) of antenna of the present embodiment does not increase nearly though tilt (tilting angle) of the antenna augments as shown in FIG. 9(B).

That is, the beam tracking error of the antenna of the present embodiment may be improved compared to that of the conventional antenna.

In short, the antenna of the present embodiment improves the beam pointing error and the beam tracking error by connecting a member for increasing electrical length to the radiators. On the other hand, the slit instead of the dielectric member may be formed to the dipole member so as to increase the electrical length of the dipole member.

Additionally, the method of increasing the electrical length of the present invention may be applied to any radiator using the combination method, and is not limited as the structure in FIG. 3. For example, end parts of the dipole members 304, 308, 312 and 316 are bent, but may not be bent. Furthermore, another feeding method other than the above feeding method may be applied to the antenna of the present invention.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

The invention claimed is:

1. A radiator used in an antenna comprising:

a first dipole member;

a second dipole member adjacent to the first dipole member;

a third dipole member facing to the first dipole member; and a fourth dipole member facing to the second dipole member, wherein the first dipole member includes a 1-1 sub-dipole member for (+) current and a 1-2 sub-dipole member for (−) current, and the third dipole member has a 3-1 sub-dipole member for (+) current and a 3-2 sub-dipole member for (−) current, and wherein a first dielectric member is combined with end part of the 1-1 sub-dipole member, and a second dielectric member is combined with end part of the 3-2 sub-dipole member, to improve a beam pointing error.

2. The radiator of claim 1, wherein the second dipole member includes a 2-1 sub-dipole member for (+) current and a 2-2 sub-dipole member for (−) current, and the fourth dipole member has a 4-1 sub-dipole member for (+) current and a 4-2 sub-dipole member for (−) current, and wherein a third dielectric member is combined with end part of the 2-1 sub-dipole member, and a fourth dielectric member is combined with end part of the 4-2 sub-dipole member.

3. The radiator of claim 2, wherein the first dielectric member and the fourth dielectric member are formed in one body, and the second dielectric member and the third dielectric member are formed in one body.

4. The radiator of claim 1, wherein the antenna is a multi-band dual polarization antenna, and the dipole members generate ±45° polarized waves through a combination method.

5. The radiator of claim 1, wherein a slit is formed to at least one of the first dipole member to the fourth dipole member.

6. A radiator employed in an antenna comprising:

a first dipole member configured to have a 1-1 sub-dipole member for (+) current and a 1-2 sub-dipole member for (−) current; and a second dipole member configured to have a 2-1 sub-dipole member for (+) current and a 2-2 dipole member for (−) current, wherein electrical length of the 2-2 sub-dipole member is longer than physical length of the 2-2 sub-dipole member in case that the electrical length of the 1-1 sub-dipole member increases, and electrical length of the 1-2 sub-dipole member is longer than physical length of the 1-2 sub-dipole member in case that the electrical length of the 2-1 sub-dipole member increases, to improve a beam pointing error.

7. The radiator of claim 6, wherein the electrical length increases through connecting a dielectric member to end part of corresponding sub-dipole member.

8. The radiator of claim 6, wherein the antenna is a multi-band dual polarization antenna, the radiator is used for low frequency band, and the dipole members generate +45° polarized wave or −45° polarized wave through a combination method.

* * * * *